United States Patent [19]

Koch

[11] 4,419,571

[45] Dec. 6, 1983

[54] STEPPED-DOWN MECHANICAL COUNTING MECHANISM

[75] Inventor: Ulf Koch, Eberbach, Fed. Rep. of Germany

[73] Assignee: Esselte Pendeflex Corporation, Garden City, N.Y.

[21] Appl. No.: 368,206

[22] Filed: Apr. 14, 1982

[30] Foreign Application Priority Data

Apr. 27, 1981 [DE] Fed. Rep. of Germany ..... 3116629

[51] Int. Cl.[3] ..... B41J 45/00; G07G 1/00

[52] U.S. Cl. ..... 235/1 C; 235/101; 235/116; 235/133 R; 101/85; 101/110

[58] Field of Search ..... 235/116, 117 A, 1 C, 235/135, 139 A, 142, 143, 101, 132 R, 132 A, 137, 133 R; 101/72, 79, 85, 99, 110

[56] References Cited

U.S. PATENT DOCUMENTS

| | | | |
|---|---|---|---|
| 1,695,964 | 12/1928 | Lang | 101/72 |
| 2,966,843 | 1/1961 | Eckley | 101/110 |
| 3,620,447 | 11/1971 | Szeluga | 235/132 R |
| 3,738,264 | 6/1973 | Sobottka et al. | 101/110 |
| 3,927,613 | 12/1975 | Nantz | 101/110 |
| 4,055,116 | 10/1977 | Roberts et al. | 101/79 |
| 4,149,460 | 4/1979 | Sato | 101/110 |
| 4,185,188 | 1/1980 | Sigl | 235/139 A |
| 4,343,238 | 8/1982 | Koch et al. | 101/85 |

FOREIGN PATENT DOCUMENTS

| | | |
|---|---|---|
| 500525 | 6/1930 | Fed. Rep. of Germany . |
| 1028138 | 4/1958 | Fed. Rep. of Germany . |
| 7331334 | 11/1973 | Fed. Rep. of Germany . |

*Primary Examiner*—Benjamin R. Fuller
*Attorney, Agent, or Firm*—Fidelman, Wolffe & Waldron

[57] ABSTRACT

Stepped-down counting mechanism with number wheels drawn on a locking shaft, with a control disc and with a slotted link. The number wheels and the control disc are moved by a ratchet shaft which is located in the interior of the locking shaft and to which are articulated pawls each acting on one pair of wheels. The switching mode with single or multiple stepping-down can be selected by adjusting the slotted link. The control disc is moved by means of an idle-stroke pawl subjected to the action of the slotted link and, independently thereof, by means of an advancing pawl acting between the control disc and the units wheel.

16 Claims, 15 Drawing Figures

STEPPED-DOWN MECHANICAL COUNTING MECHANISM

The invention relates to a stepped-down mechanical counting mechanism, in which number wheels are mounted on a locking shaft so as to adjoin one another without a gap, and a control disc is connected in front of the units wheel, the number wheels and control disc being driven by a ratchet shaft which is located in the interior of the locking shaft and rotates to and fro through a working angle and to which are articulated spring-loaded pawls each acting on one pair of wheels.

Such a counting mechanism is described as the first exemplary embodiment of German patent application No. P 3001321.9and correspnding U.S. Pat. No. 4,343,238. It serves as a printing mechanism for consecutive, preferably decimal numbering and is designed, likewise, for direct as well as stepped-down advancing. Such a counting mechanism can be used, in particular, in a hand labelling machine. Direct advancing is employed when individual articles are to be marked with consecutively numbered labels. In this switching mode, referred to below as mode M1, an advancing movement of the number wheel of the lowest numerical place (units wheel) therefore takes place during each stroke of the ratchet shaft. On the other hand, if pairs of articles are to be marked, two identical labels have to be printed. In the corresponding switching mode M2, advancing of the counting mechanism is effected only during every second stroke of the ratchet shaft. Consequently, a switching stroke of the counting mechanism alternates with an idle stroke. For larger groups of articles, for example linen sets in three or more parts, sets of crockery, etc., a correspondingly larger number of idle strokes is necessary between the switching strokes. Accordingly, the abovementioned counting mechanism according to the state of the art also operates with multiple or repeated switching which provides for two (M3), three (M4) or even more idle strokes between two switching strokes. Moreover, it is known to stop completely the advancing of the counting mechanism (switching mode M0).

In the counting mechanism mentioned, the desired switching mode is predetermined by the graduation of a control disc. A particular control disc which is built fixedly into the machine is necessary for each switching mode. As a result, in each case, a counting mechanism is produced having a quite definite switching mode which cannot be changed directly by the user.

This restriction to a permanently predetermined switching mode has proved disadvantageous in practice. Particularly in the case of hand labelling machines, it is frequently necessary to change the switching mode because of the varying unit quantities of the articles to be marked. At present, however, a complete printing mechanism, which is exchanged as required, must be available for each switching mode.

The object of the invention is to remedy this deficiency and to provide a counting mechanism of the type mentioned in the introduction, which permits an alteration of the switching mode by a simple change-over and, in particular, a preselection of no (M1), one (M2), two (M3) or three (M4) idle strokes between two switching strokes moving the counting mechanism. The extremely compact design of the counting mechanism according to the above-referenced German Patent Specification with wheels adjoining one another without a gap and with low-wear switching is still to be retained here.

This object is achieved, by means of a counting mechanism of the type mentioned in the introduction, due to the fact that the control disc can be advanced by means of an idle-stroke pawl subjected to the action of an adjustable slotted link and, independently thereof, by means of an advancing pawl acting between the control disc and the units wheel.

Advantageous developments of the invention are characterised in the sub-claims.

Provided by means of the invention is a stepped-down counting mechanism, in which the switching mode can be preselected by adjusting a slotted link. The benefits of such an arrangement are obvious. For example, the counting mechanism according to the invention, in a hand labelling machine, can replace several of the printing mechanisms having a fixed switching mode, which are required according to the state of the art. However, the invention can also be applied advantageously in other counting or numbering machines.

The invention is explained in more detail with reference to an exemplary embodiment illustrated in the drawings. Here, the stepped-down counting mechanism is described in its use as a printing mechanism advancing by decimal places.

Figure 11:
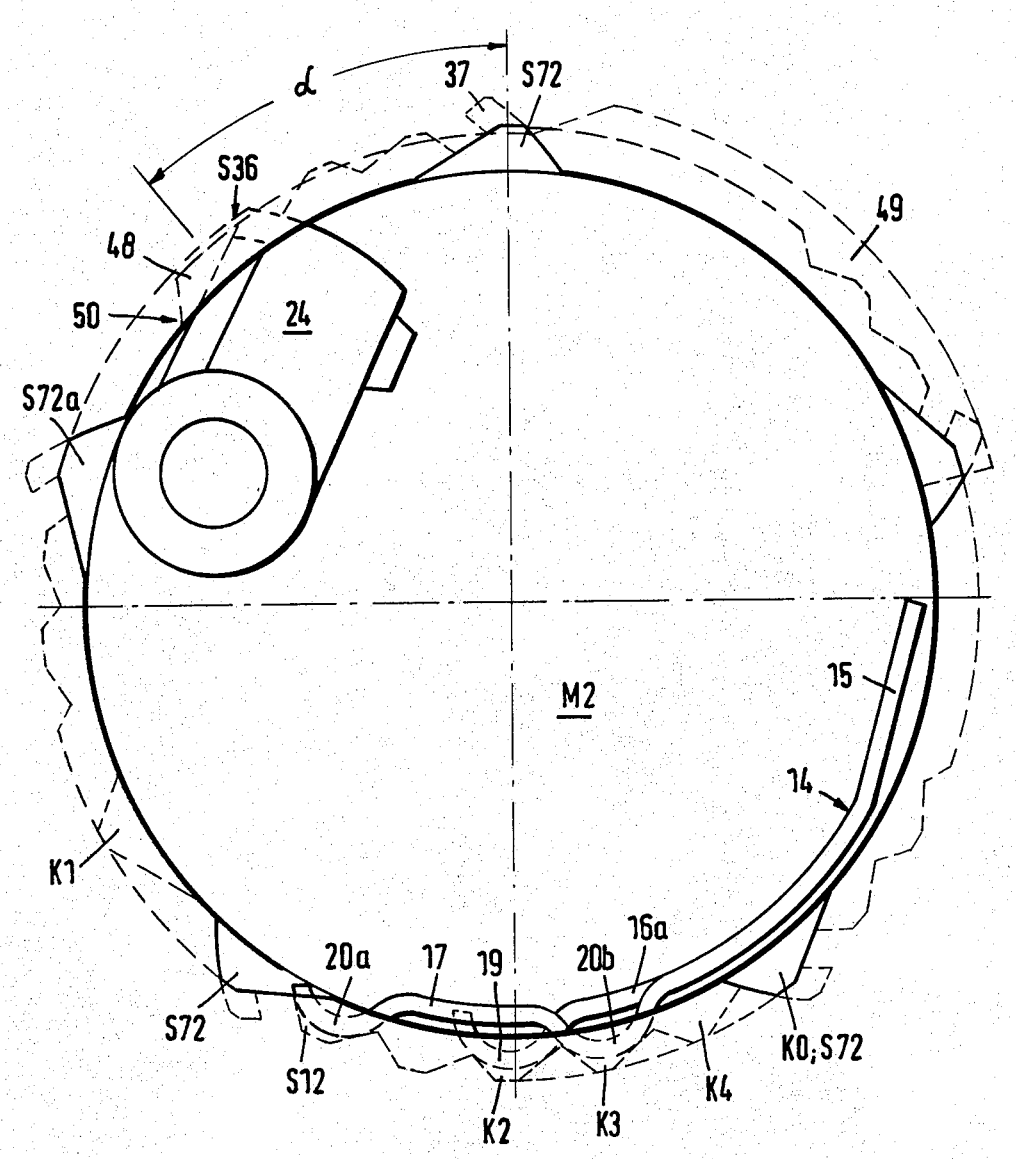
Figure 12:
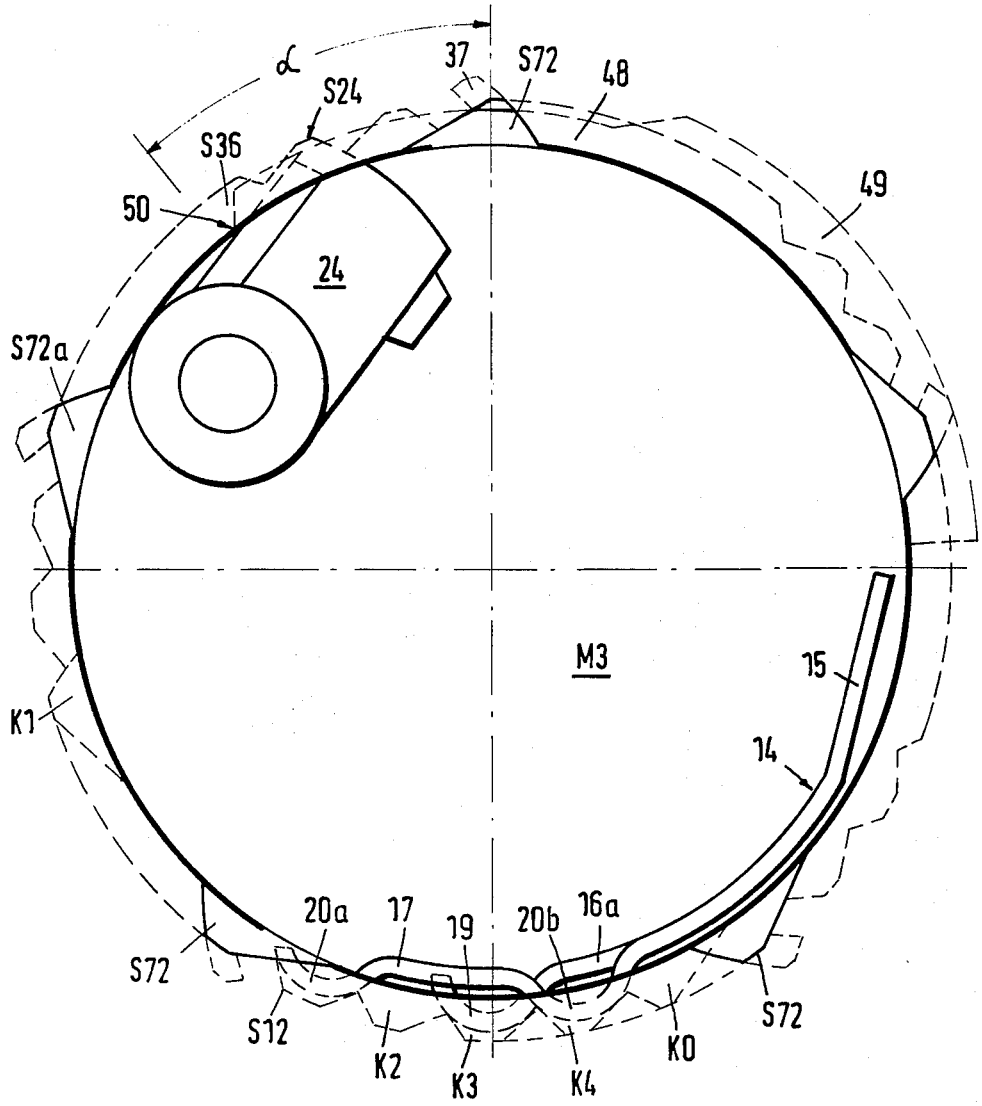
Figure 13:
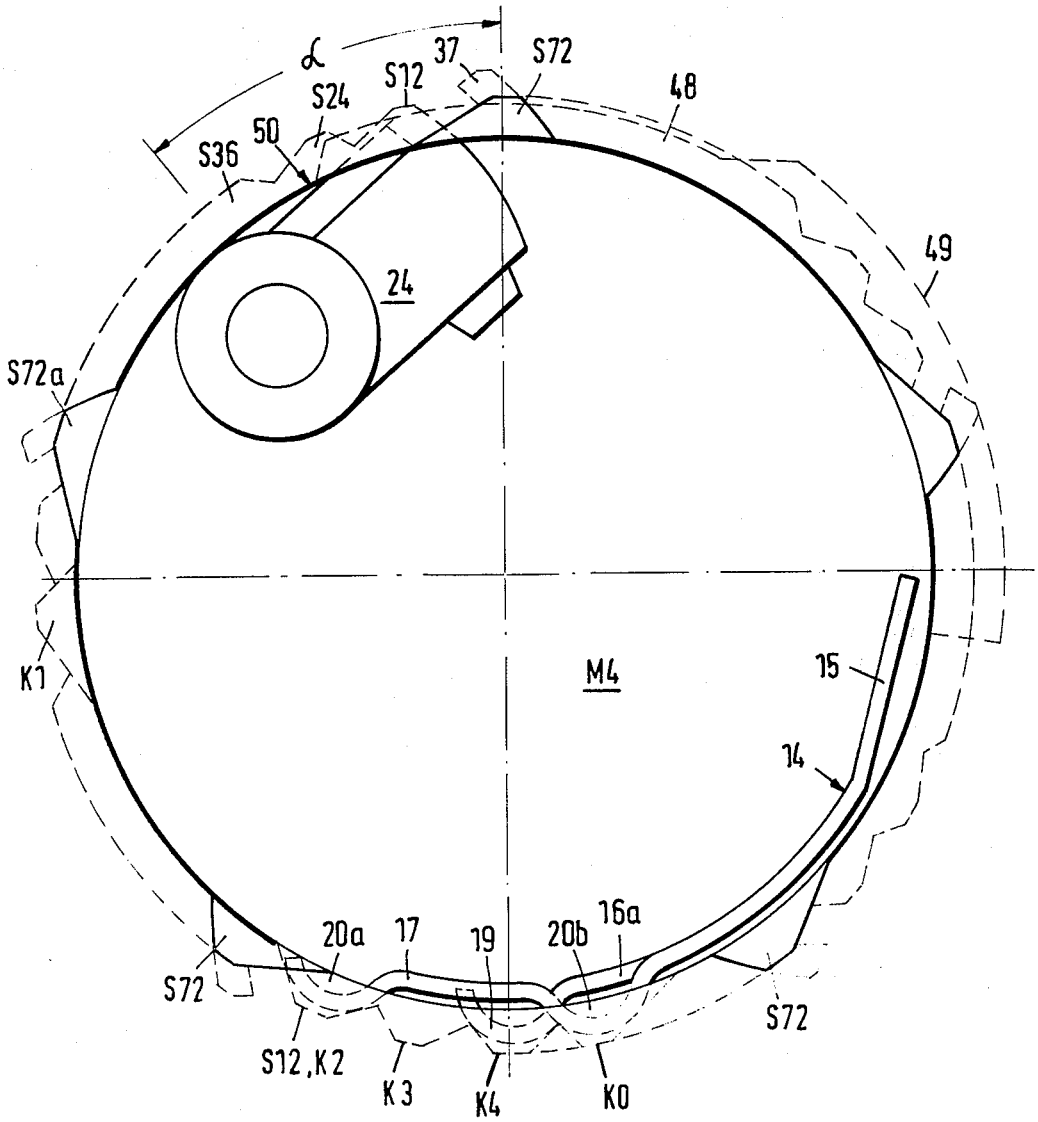
Figure 14:
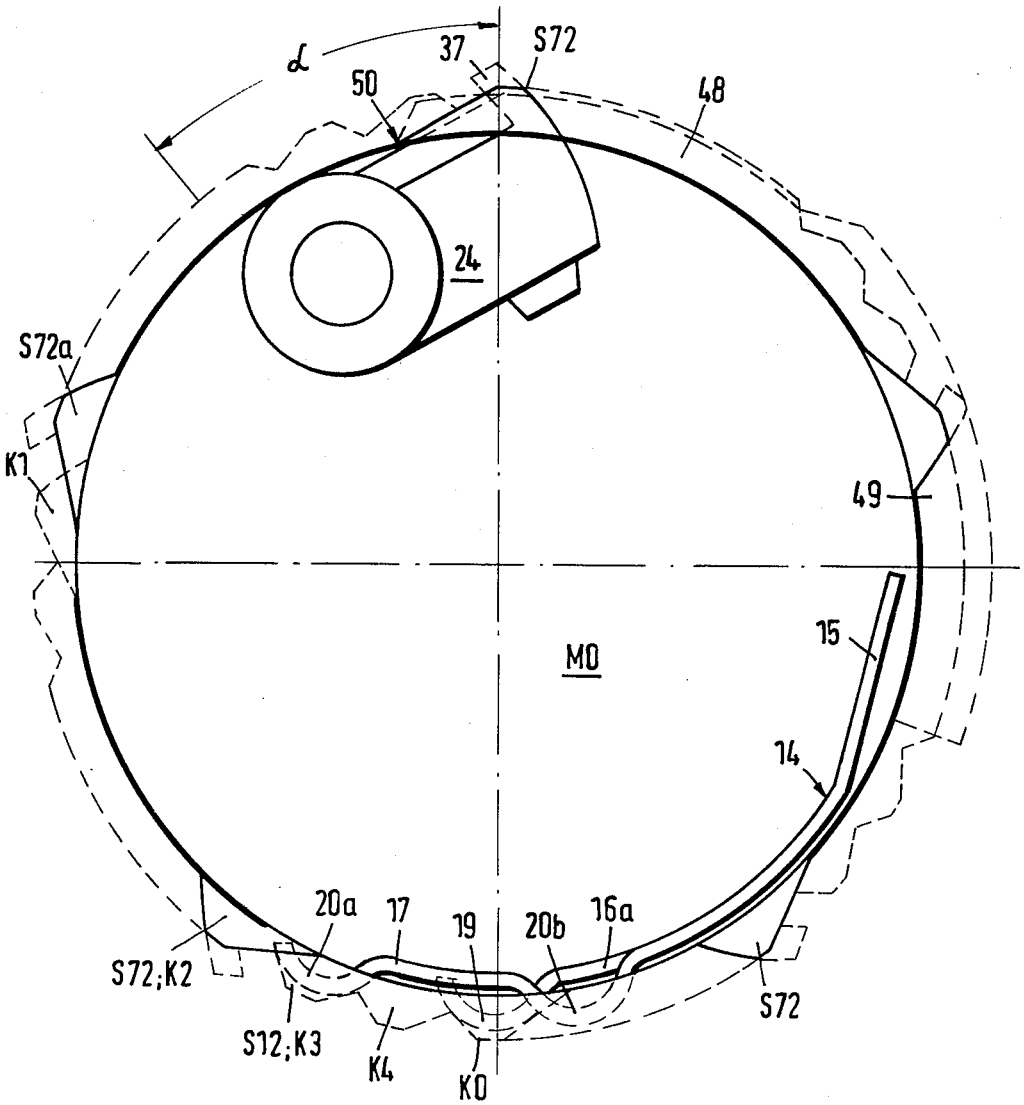
Figure 15:
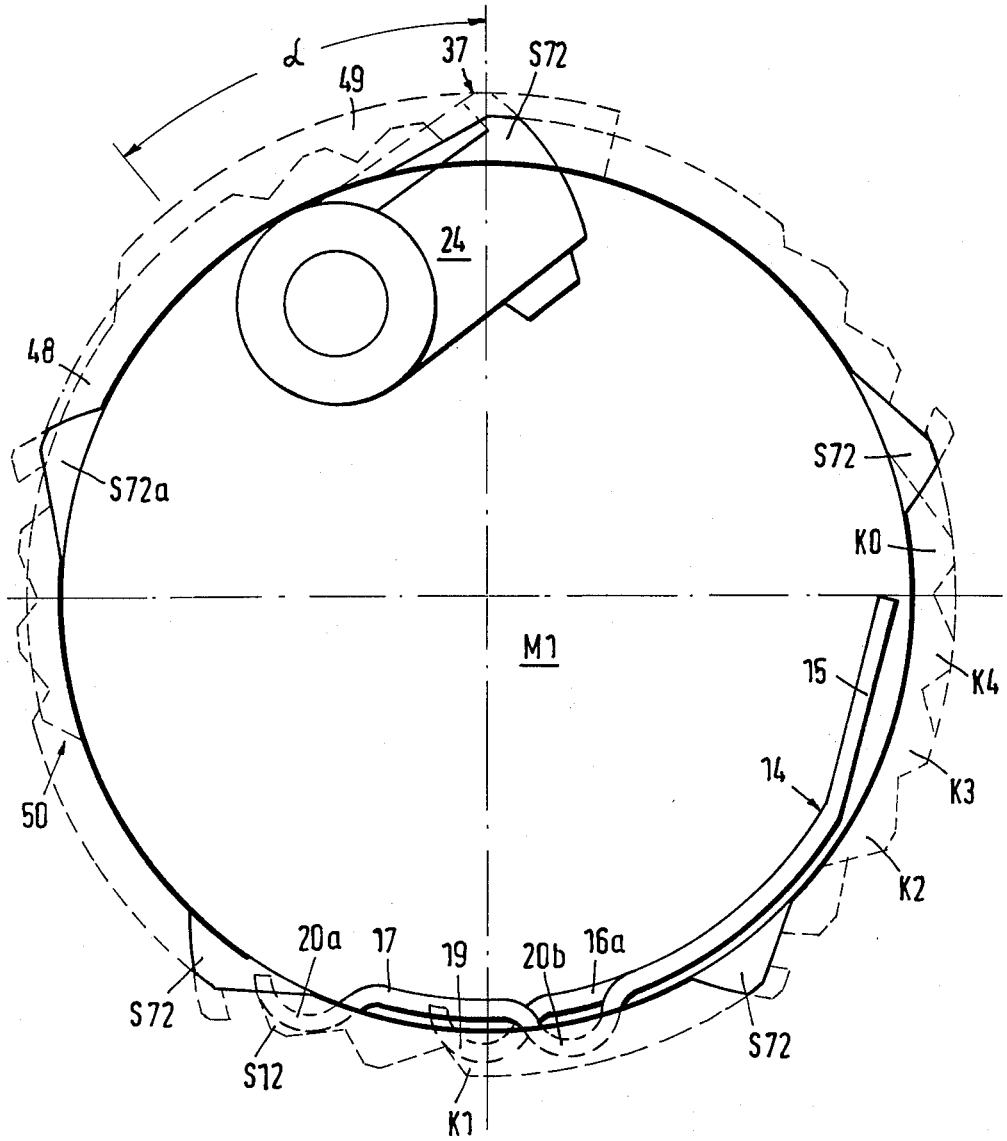

FIGS. 11 to 15 show diagrams illustrating the position of the slotted link and the control disc after switching of the units wheel, specifically FIG. 11 for switching mode M2;
FIG. 12 for switching mode M3;
FIG. 13 for switching mode M4;
FIG. 14 for switching mode M0;
FIG. 15 for switching mode M1.

Figure 1:
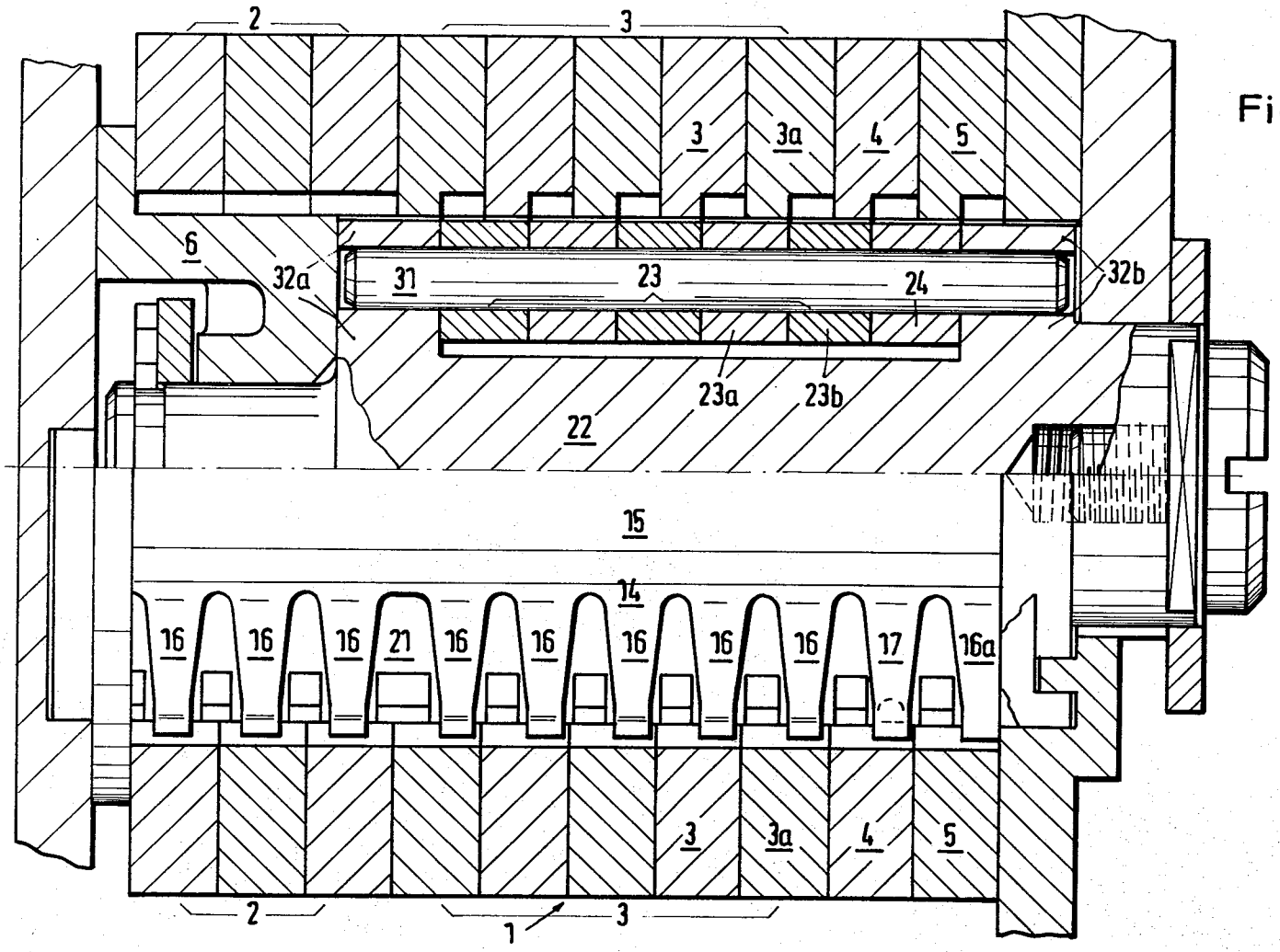
FIG. 1 shows a view in a longitudinal section through the counting mechanism.

According to FIG. 1, the counting mechanism 1 advancing by decimal places is combined with number wheels 2 which are adjustable exclusively by hand. This arrangement is used in labelling machines in which a label is printed with a permanently predetermined mark and, at the same time, with a serial number. The manually adjustable number wheels 2 are drawn, together with number wheels 3 advancing by decimal places, a control disc 4 and a slotted link 5, on a common locking shaft 6. Here, the control disc 4 is located in front of the units wheel 3*a*, that is to say, the lowest placed of the advancing number wheels 3. The slotted link 5 is, in turn, connected in front of the control disc 4 on the drive side. The wheels drawn onto the locking shaft, that is to say the number wheels 2; 3, the control disc 4 and the slotted link 5, adjoin one another without a gap and are supported laterally against one another. They can be rotated individually independently of one another and are positioned and locked on the locking shaft 6 in angular positions offset to one another one step at a time.

Figure 3:
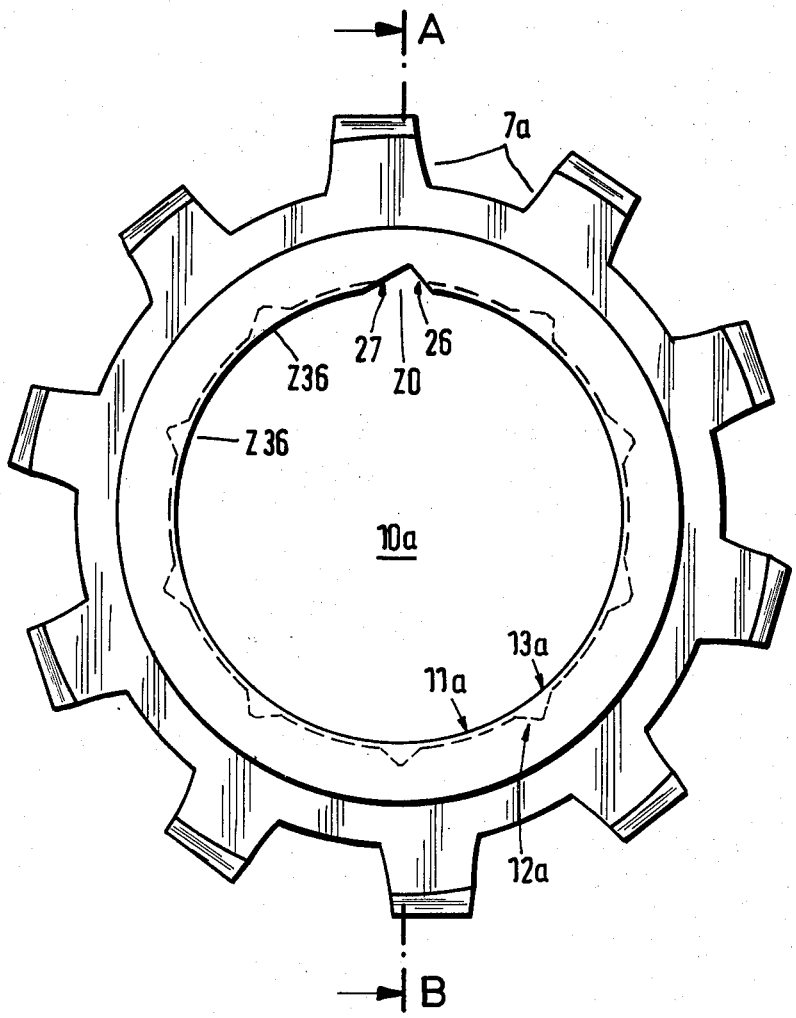
FIG. 3 shows a plan view of a number wheel of the counting mechanism.

The number wheels 2; 3 are gearwheels with an external toothing *7a* (see FIG. 3). Likewise, the slotted link 5 is also provided with an external toothing *7b* (see FIG. 9). An adjusting mechanism (not shown) by means of which the number wheels 2; 3 and the slotted link 5 are brought into a pre-selectable position, engages into this external toothing *7a; 7b*.

Figure 2:
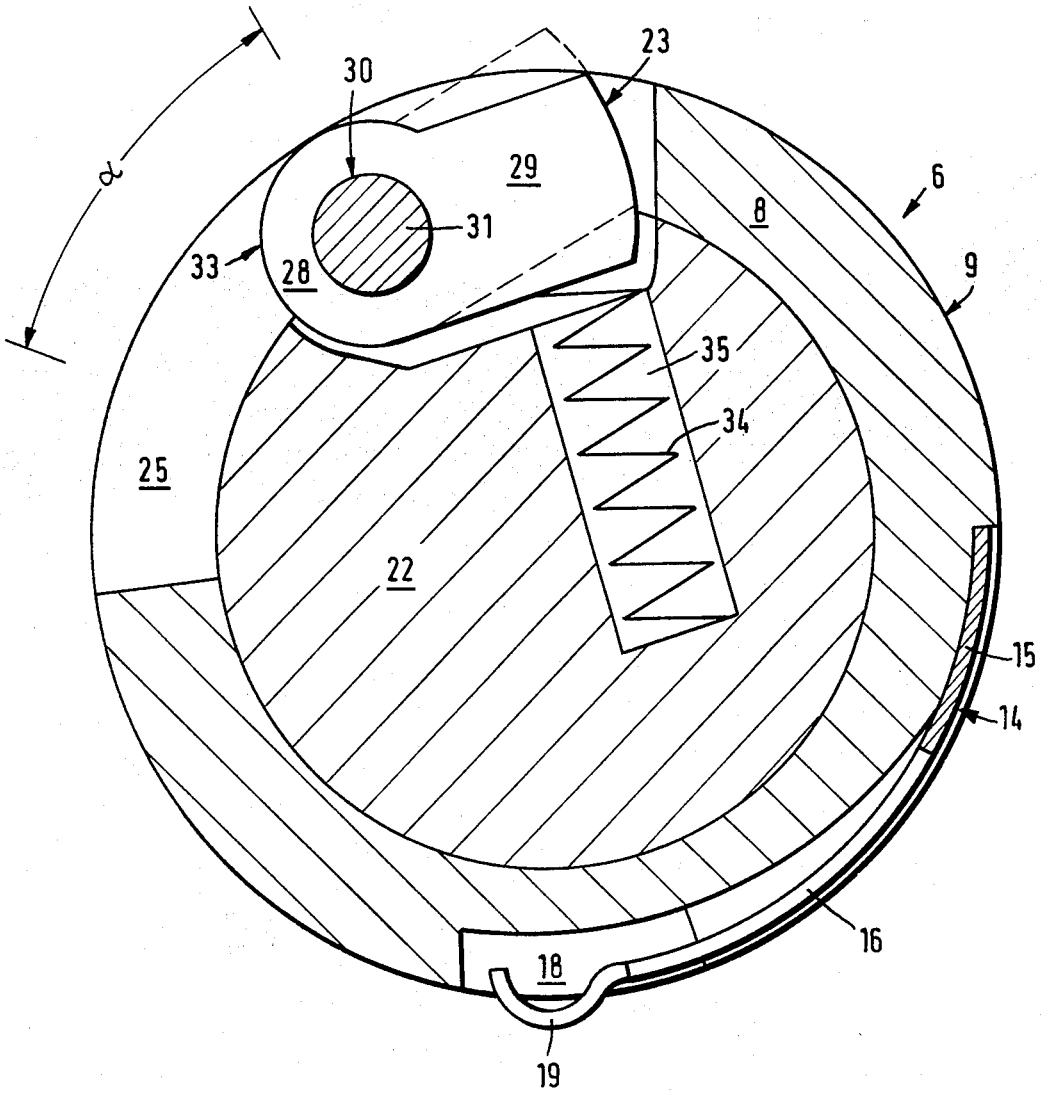
FIG. 2 shows a partial side view of the counting mechanism.

As is evident in FIG. 2, the locking shaft 6 is a slotted cylindrical sleeve 8, the outer shell 9 of which constitutes the running face of the number wheels 2, 3, the control disc 4 and the slotted link 5. Said wheels each have a central middle bore 10*a; 10b; 10c*, the clear width of which corresponds to the diameter of the sleeve 8, and are threaded onto the sleeve 8. The inner ring 11*a; 11b; 11c* of the middle bore 10*a; 10b; 10c* is provided, in each case, with a notch. In the case of the manually adjustable number wheels 2, this consists of a single gear rim taking up the full width of the number wheels 2. On the other hand, in the case of the advancing number wheels 3 and the control disc 4, a gear rim 12*a; 12b* on the drive side and a gear rim 13*a; 13b* on the driven side are recessed, in each case, on the inner ring 11*a; 11b*. The gear rim 12*a; 12b* on the drive side and the gear rim 13*a; 13b* on the driven side each take up a part of the width, preferably half the width, of the advancing number wheel 3 and of the control disc 4.

The notch on the inner ring 11*c* of the slotted link 5 is also divided in its width. Here, a locking toothing 12*c* is provided on the side of the slotted link 5 which faces away from the control disc 4. On the other hand, a guide path 13*c* applying the effect of the slotted link is shaped on the other side facing the control disc 4. Analogously to the advancing number wheels 3 and the control disc 4, the locking toothing 12*c* and the guide path 13*c* preferably take up half the width of the slotted link 5.

The notches of the wheels drawn onto the locking shaft 6 interact with a spring comb 14 for positioning the wheels. A front view of the spring comb 14 can be seen from FIG. 1 and a side view from the illustrations of FIG. 2 and FIGS. 11 to 15. The spring comb 14 is located on the outer shell 9 of the sleeve 8 and is partly countersunk into the sleeve 8. It consists of a comb back 15 and leaf springs 16; 16*a;* 17 projecting from this in the form of prongs. In the relaxed state, the leaf springs 16; 16*a;* 17 project over at least part of their length beyond the outer shell 9 of the sleeve 8 and, as a result of radial pressure, can be countersunk into a spring bed 18 underneath the outer shell 9 (see FIG. 2).

An individual leaf spring 16; 16*a;* 17 is provided for each of the wheels on the locking shaft 6. The leaf springs 16 for the number wheels 2; 3 and the leaf spring 16*a* for the slotted link 5 are designed identically. They each carry at the spring end an individual knob 19. The leaf spring 17 for the control disc 4 is, on the other hand, provided with two knobs 20*a; 20b* located at a specific distance from one another (see FIGS. 11 to 15). The knobs 19; 20*a; 20b* drop as a result of spring force into the notches of the wheels and thereby lock the wheels in specific locking positions. In the case of the manually moved number wheels 2, the leaf springs 16; 16*a;* 17 run centrally on the continuous gear rim, in the case of the advancing number wheels 3 and the control disc 4 on the gear rim 12*a* and 12*b* respectively on the drive side, and in the case of the slotted link 5 on the locking toothing 12*c*. This results in an offset of the leaf springs 16; 16*a;* 17, which leads to the formation of a single larger comb gap 21 at the joint between the manually moved and the advancing number wheels 2 and 3 respectively (see FIG. 1).

Inserted through the sleeve 8 is a ratchet shaft 22, by means of which the advancing number wheels 3 and the control disc 4 are moved. The ratchet shaft 22 is mounted rotatably in the interior of the sleeve 8. During each stroke of the counting mechanism 1, it is rotated to and fro through a definite working angle $\alpha$. In the case of a counting mechanism 1 advancing by decimal places, the switching angle of the number wheels is 36°. Accordingly, the working angle $\alpha$ of the ratchet shaft 22 must be selected somewhat larger, in order to compensate mechanical tolerances and inaccuracies in the notches. In the present exemplary embodiment, the working angle $\alpha$ amounts to 40°.

Articulated to the ratchet shaft 22 is a series of pawls 23; 23*a;* 23*b;* 24, which drop into the notches of the advancing number wheels 3 and of the control disc 4 respectively, and which drive these at a definite switching rhythm. In so doing, the pawls 23; 23*a;* 23*b;* 24 engage through a slot 25 in the sleeve 8 into notches Z; S of the gear rims 12*a;* 12*b;* 13*a;* 13*b*. Each of these notches Z; S (see FIG. 3) has a steep front side 26 in the advancing direction of the wheels to be moved. When they drop into the notches Z; S, the pawls 23; 23*a;* 23*b;* 24 strike against this front side 26 and, during the forward rotation of the ratchet shaft 22, transmit the drive force to the wheels. A second, rearward side 27 of the notches Z; S serves as a sliding face on which the pawls 23; 23*a;* 23*b;* 24 are guided along and lifted out when the ratchet shaft 22 is turned back.

According to the basic form (see FIG. 2), each of the pawls 23; 23*a;* 23*b;* 24 consists of an essentially cylindrical, centrally perforated jointed body 28 and of a projection 29 which projects radially therefrom and which is designed as the negative form of a notch Z; S. The pawls 23; 23*a;* 23*b;* 24 are pushed, by means of the bore 30 of their jointed body 28, next to one another on a pin 31 as a common axle. The pin 31 is retained parallel to the ratchet shaft 22 by means of two carriers 32*a;* 32*b* shaped on the ratchet shaft 22 and is connected fixedly to the ratchet shaft 22.

The pawls 23; 23*a;* 23*b;* 24 can rotate about the pin 31 with a play of movement. The axial centre point of the pin 31 is located so that the outer wall 33 of the jointed body 28 of a pawl 23; 23*a;* 23*b;* 24 threaded onto the pin 31 lies within an extended outer peripheral circle of the sleeve 8 (see FIG. 2). Consequently, the pawls 23; 23*a;* 23*b;* 24 are countersunk with their jointed bodies 28 below the running face of the wheels. The projection 29 of the pawls 23; 23*a;* 23*b;* 24 can likewise be set back below the running face of the wheels as a result of rotation of the pawl 23; 23*a;* 23*b;* 24 about the pin 31 (unbroken line in FIG. 2). However, in this position, each individual pawl 23; 23*a;* 23*b;* 24 is loaded by the force of a compression spring 34. The compression springs 34 are mounted in suitable blind bores 35 in the ratchet shaft 22. They act upon the projections 29 of the pawls 23; 23*a;* 23*b;* 24 in such a way that the pawls 23; 23*a;* 23*b;* 24 are rotated about the pin 31 and the projections 29 are pressed radially outwards against the notches of the advancing number wheels 3 and control disc 4 respectively (broken line in FIG. 2). The pawls 23; 23*a;* 23*b;* 24 engage on the arc of the working angle $\alpha$ and move the advancing number wheels 3 and the control disc 4 from locking position to locking position.

FIG. 1 shows the arrangement of the pawls 23; 23*a;* 23*b;* 24 in relation to the wheels to be moved. Within the decimal counting mechanism, a pawl 23*a* is assigned to each pair of advancing number wheels 3, 3*a*. The advancing number wheels 3; 3*a* are drawn onto the locking shaft 6 and are offset to the pawls 23; 23*a* in such a way that a pawl 23*a* overlaps the joint between two number wheels 3; 3*a*. The pawl 23*a* runs, in each case, with the one half of its width in the gear rim 13*a*, on the driven side, of a number wheel 3*a* of a low numerical place and with the other half of its width in the gear rim 12*a*, on the drive side, of the number wheel 3 of the next higher numerical place. The same applies correspondingly to the control disc 4. A pawl designated below as an advancing pawl 23*b* runs with half of its width in the gear rim 13*b*, on the driven side, of the control disc 4 and the other half runs in the gear rim 12*a*, on the drive side, of the units wheel 3*a*. A pawl referred to below as an idle-stroke pawl 24 runs with the one half of its width in the gear rim 12*b*, on the drive side, of the control disc 4 and with the other half of its width on the guide path 13*c* of the slotted link 5.

Figure 4:
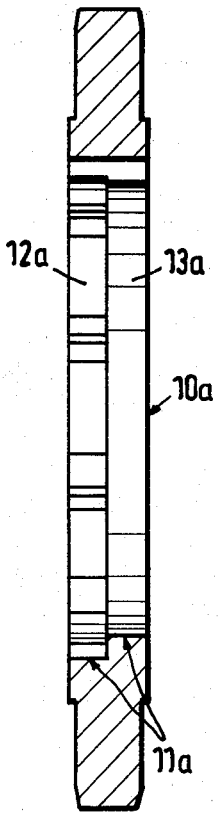
FIG. 4 shows a side view in a cross-section along the line A–B of FIG. 3.

The abovementioned wheels of the counting mechanism 1 are described in more detail below. The illustrations of FIG. 3 and FIG. 4 show, in the first place, the design of the advancing number wheels 3; 3*a*. According to these, the advancing number wheels 3; 3*a* are provided, as already mentioned, with an external toothing 7*a* which permits the engagement of an adjusting mechanism. The inner ring 11*a* limiting the middle bore 10*a* has, on the drive side, a gear rim 12*a* with ten identical notches Z36 arranged at the same angular distance from one another. On the other hand, the gear rim 13*a* on the driven side consists of a single notch Z0 which is aligned with one of the notches Z36 on the drive side and which thus forms a continuous notch Z0. As a result of this arrangement, a pawl 23*a* working within the decimal counting mechanism runs lifted out, during nine out of ten strokes of the ratchet shaft 22, on the unnotched inner ring 11*a* of a number wheel 3*a* of a low numerical place and is engaged into the continuous notch Z0 during only one of ten strokes. By means of this stepping-down ratio of 1:10 and a coupling of the pawls 23; 23*a;* 23*b;* 24, which is known from the above-referenced German Patent Specification, a decimal advancing of the counting mechanism 1 is achieved.

Figure 5:
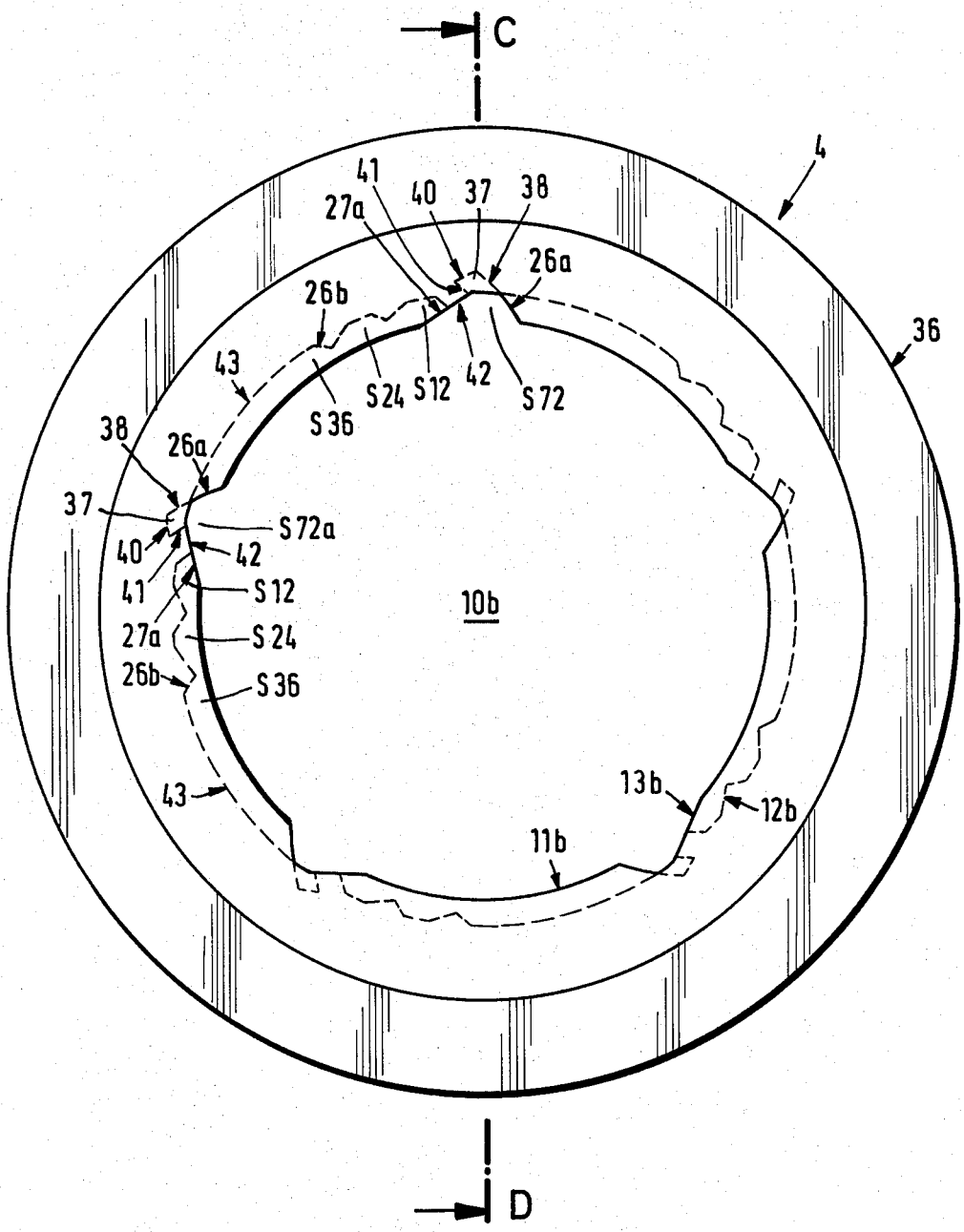
FIG. 5 shows a plan view of the control disc of the counting mechanism.
Figure 6:
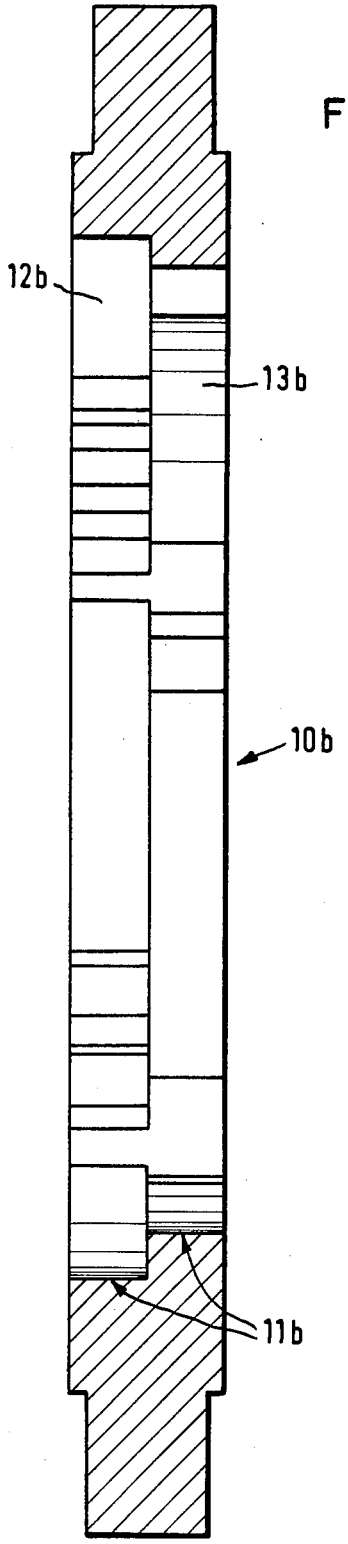
FIG. 6 shows a side view in a cross-section along the line C–D of FIG. 5.

FIG. 5 and FIG. 6 show the control disc 4 of the counting mechanism 1. In contrast to the number wheels 2; 3 and the slotted line 5, this is not moved manually and therefore has an outer contour 36 free of toothing. As already mentioned, the inner ring 11*b* of the control disc 4 is provided with a notch which is divided in its width and which consists of a gear rim 12*b* on the drive side and of a gear rim 13*b* on the driven side.

The gear rim 13*b* on the driven side is formed by five 72° notches S72; S72*a* arranged at angular intervals of 72° from one another. The gear rim 12*b* on the drive side has, likewise, a five-digit symmetry. It consists of groups of notches which are each assigned to one of the 72° notches S72; S72*a* of the gear rim 13*b* on the driven side. Initially, each 72° notch S72; S72*a* on the drive side is recessed into an incision 37. Thus, the front edge 38 of this incision 37 lies in the extension of the front side 26*a* of the 72° notch S72; S72*a*. This guidance of the front edge 38 permits a pivoting movement of the idle-stroke pawl 24 through a relatively large angle into a special deep engagement position. In this position, which is required only for the switching mode M1, a hook 39 shaped on the idle-stroke pawl 24 locks into the incisions 37 (see FIG. 15).

The front edge 38 of the incision 37 merges into a plateau 40 which forms a stop for the hook 39. Starting from this plateau 40, the rear edge 41 of the incision 37 descends parallel to the front edge 38 and at a distance from the latter which corresponds to the width of the hook 39. In so doing, the rear edge 41 comes up against the rearward side 27*a* of the 72° notch S72; S72*a* on the driven side. The gear rim 12*b* on the drive side follows this side 27*a* over a short section 42 which is formed over the full width of the control disc 4. Consequently, of the 72° notch S72; S72*a*, only this short section 42 is present on the drive side of the control disc 4. Further notches then adjoin this length 42 on the drive side. In particular, a 12° notch S12, a 24° notch S24 and a 36° notch S36 are located after the 72° notches S72, each at an angular interval of 12°. The 36° notch S36 is designed without the conventional rearward side 27, with only a front side 26*b* as a stop face in the advancing direction. The outer end of this front side 26*b* merges into a ring edge 43 without toothing, which extends parallel to the inner ring 11*b* and which leads onto the incision 37 of the next 72° notch S72*a*.

As alredy mentioned, the leaf spring 17 serving for locking the control disc 4 has two knobs 20*a;* 20*b*. Locking positions of the control disc 4 are defined as a result of the engagement of these knobs 20*a;* 20*b* into the gear rim 12*b* on the drive side. The knobs 20*a;* 20*b* are engaged offset 36° to one another. Locking positions with the gear rim 12*b* on the drive side are provided every 12°, as becomes clear from the consideration which follows.

The 12° notches S12 and the 24° notches S24 are formed completely in the gear rim 12*b* on the drive side. On the other hand, the 36° notches S36 and 72° notches S72; S72*a* are incomplete, and have complementary pieces. As already described, the 36° notch S36 has the front side 26*b*, whereas the 72° notch S72; S72*a* has a part of the rearward side 27*a* in the form of the section 42. The leaf spring 17 engages with these incomplete notches in such a way that one knob 20*a* rests against the section 42 of the 72° notch S72 and the other knob 20*b* rests against the front side 26*b* of the 36° notch S36. Each time the control disc is rotated through 12° the next two locking positions are obtained from this position, as a result of engagement of the knob 20*a* into the complete notches S12 and S24, whilst the other knob 20*b* runs freely on the ring edge 43. After a further 12°, the two knobs 20*a* and 20*b* again drop, with their roles reversed, into the incomplete notches S36 and S72*a*, and the subsequent positions are also repeated analogously. Consequently, the control disc 4 is actually locked at the angular interval of 12° indicated.

Figure 7:
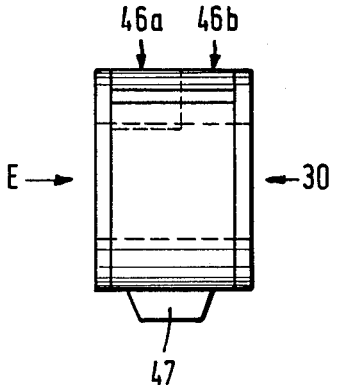
FIG. 7 shows an enlarged front view of the idle-stroke pawl.
Figure 8:
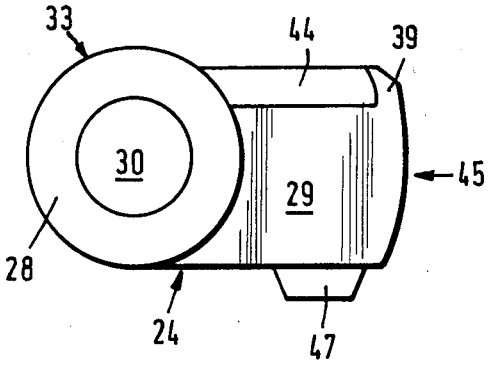
FIG. 8 shows a side view of the idle-stroke pawl in the direction "E" of FIG. 7.

As already mentioned, the recessed incisions 37 on the drive side of the control disc 4 permit a special deep engagement position of the idle-stroke pawl 24. The correspondingly modified form of the idle-stroke pawl 24 is to be seen in the illustrations of FIG. 7 and FIG. 8. According to these, the projection 29 of the idle-stroke pawl 24 is provided with a groove 44 which extends from the jointed body 28 close up to the front edge 45 of the projection 29. The remaining piece of the projection 29 forms the hook 39 which can drop into the recessed incisions 37. The groove 44 and the hook 39 take up the half side 46*a* of the idle-stroke pawl 24 which acts on the control disc 4. The other half side 46*b* of the idle-stroke pawl 24, running on the slotted link 5, has, on the other hand, the full outer contour of the projection 29.

In contrast to the advancing pawl 23*b*, and to the pawls 23*a* which act between advancing number wheels 3, which are all provided, in a known way, with a coupling mechanism (not shown), the idle-stroke pawl 24 works freely and independently of the other pawls 23; 23*a*. Consequently, no further driving devices are provided on the projection 29. For the sake of completeness, it should be mentioned that all the pawls 23; 23*a*; 23*b*; 24 carry on the underside of the projection 29 a peg 47 (not shown in FIG. 2) which serves to guide the compression spring 34.

Figure 9:
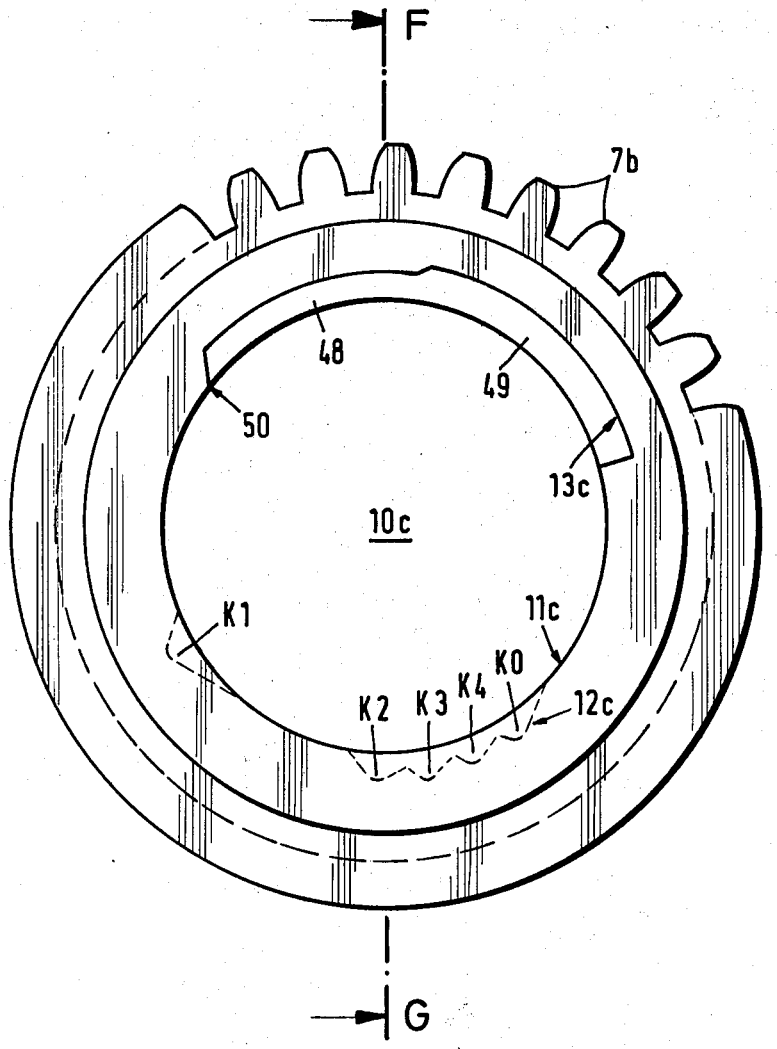
FIG. 9 shows a plan view of the slotted link of the counting mechanism.
Figure 10:
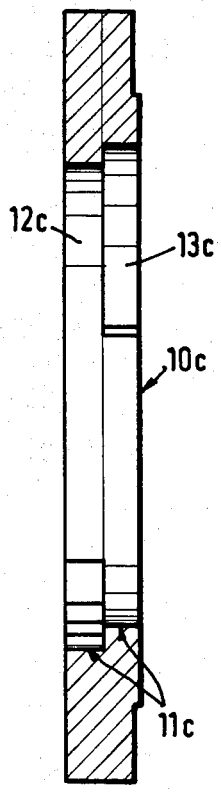
FIG. 10 shows a side view in a cross-section along the line F–G of FIG. 9.

The form of the slotted link 5 can be seen in the illustrations of FIG. 9 and FIG. 10. The slotted link 5 is an adjustable wheel drawn onto the locking shaft 6. It is provided with a continuous external toothing 7*b* which is illustrated in FIG. 9 only on part of the periphery. There engages into the external toothing 7*b* an adjusting mechanism (not shown), by means of which the slotted link 5 is rotated into different locking positions. The slotted link 5 is moved only manually, and is consequently not driven by the idle-stroke pawl 24.

As already mentioned, the inner ring 11*c* of the slotted link 5 is provided, on the side facing away from the control disc 4, with the locking toothing 12*c* and, on the side facing the conftrol disc 4, with the guide path 13*c*. The locking toothing 12*c* consists of the notches K0, K1, K2, K3 and K4. Locking positions of the slotted link 5 are defined by the engagement of a leaf spring 16*a* into one of these notches. The engagement position corresponds to a selected switching mode MO (notch K0), M1 (notch K1), M2 (notch K2), M3 (notch K3) or M4 (notch K4).

There runs on the guide path 13*c* the half side 46*b* of the idle-stroke pawl 24 which is controlled, in this way, by the contour of the guide path 13*c*. The guide path 13*c* consists of two curves 48; 49. The two curves 48; 49 each span the full working angle $\alpha$ of the ratchet shaft 22. A first, shallow curve 48 is assigned to the locking positions in the notches K0, K2, K3 and K4 and to the switching mode M0, M2, M3 and M4. The shallow curve 48 is cut out to such a depth that, although the idle-stroke pawl 24 running thereon engages with the notches S12; S24; S36 of the control disc 4, it nevertheless does not engage with the recessed incisions 37 of the control disc 4. A second, recessed curve 49 is assigned to the locking position in the notch K1, that is to say, the switching mode M1. Its depth is selected so that the idle-stroke pawl 24 can drop with the hook 39 into the recessed incisions 37.

The notches K0, K2, K3 and K4 of the slotted link 5 are each arranged at an angular interval of 12° from one another. The reason for this is made clear in the functional description below, with reference to the illustrations of FIGS. 11 to 15.

The illustrations of FIGS. 11 to 15 show diagrammatically the relative positions of the control disc 4 and the slotted link 5, in each case after the completion of a switching stroke, by means of which the units wheel 3*a* of the counting mechanism 1 has been advanced. To carry out this switching operation, one of the 72° notches S72 of the control disc 4 stood at the start of the working angle $\alpha$ and was aligned with one of the ten notches Z36 on the drive side of the units wheel 3*a*. As a result, it was possible for the advancing pawl 23*b* to drop, and the control disc 4 and the units wheel 3*a* were rotated synchronously through 36°. The 72° notch S72 of the control disc thereby reached the position shown in FIGS. 11 to 15, at the end of the working angle $\alpha$. Since the next 72° notch S72*a* of the control disc 4 appears only at the angular interval of 72°, the advancing pawl 23*b* is first lifted out of the notches Z36 of the units wheel 3*a* by the inner ring 11*b* on the driven side of the control disc 4. Consequently, no second switching stroke of the units wheel 3*a* can normally take place directly.

In the position of the slotted link shown in FIG. 11, where the slotted link 5 is locked in the notch K2, the switching mode M2 is preselected. Accordingly, in the starting position described, one idle stroke in which the units wheel 3*a* of the counting mechanism 1 is not moved must be carried out. According to FIG. 12, the switching mode M3 is preselected as a result of locking of the slotted link 5 in the notch K3. Two idle strokes must therefore take place. FIG. 13 relates, correspondingly, to the switching mode M4 with locking of the slotted link 5 in the notch K4 and three idle strokes. In FIG. 14, the slotted link 5 engages in the notch KO. The advancing of the counting mechanism 1 is, as a result, completely interrupted (switching mode MO), and the counting mechanism 1 remains, over any number of strokes, in the position reached last. In FIG. 15, advancing without stepping-down is effected as a result of locking of the slotted link 5 in the notch K1 (switching mode M1). Consequently, during each stroke of the ratchet shaft 22, the units wheel 3*a* of the counting mechanism 1 is moved on one place.

If FIG. 11 with the switching mode M2 is first considered, the idle-stroke pawl 24 is seen to be engaged with the 36° notch S36 of the control disc 4, which stands at the start of the working angle $\alpha$. The idle-stroke pawl 24 rests against the front side 26*b* which is made complete in the otherwise incomplete 36° notch S36. The shallow curve 48 of the slotted link 5 spans the full arc of the working angle $\alpha$ and does not limit the switching angle of the idle-stroke pawl 24. Consequently, during the forthcoming stroke of the ratchet shaft 22, the control disc 4 is rotated by the idle-stroke pawl 24 through a full 36°. The advancing pawl 23*b* is lifted out in this way. During the next following switching stroke, the advancing pawl 23*b* again engages into a 72° S72*a* of the control disc 4, and the units wheel 3*a* is switched. The idle-stroke pawl 24 is likewise pivoted, but has no drive function, since the front side of the 72° notch S72; S72*a* is not shaped on the drive side of the control disc 4. Consequently, in the switching mode M2, the control disc 4 is rotated 36° alternately either by the drive side or by the driven side, the units wheel 3*a* being moved only during the stroke of the advancing pawl 23*b* which acts on the driven side.

In the switching mode M2, the idle-stroke pawl 24 runs on the shallow curve 48 of the slotted link 5. This has, initially, the function of blocking engagement of the hook 39 shaped on the idle-stroke pawl 24 into the recessed incisions 37 of the control disc 4. The same also applies to the switching modes M0, M3 and M4. Moreover, in the mode M2, the terminal edge 50 of the shallow curve 48 stands at the start of the working angle $\alpha$. Here, the slotted link serves to prevent an incorrect enlargement of the switching travel and to compensate possible inaccuracies in the toothing.

In the switching mode M3 illustrated in FIG. 12, the slotted link 5 is offset 12° in the advancing direction relative to the mode M2. The corresponding angular interval between the notches K0, K2, K3 and K4 has already been mentioned. The shallow curve 48 of the slotted link 5 therefore spans the working angle $\alpha$ of the ratchet shaft 22 only over an arc length which shortens the switching angle of the idle-stroke pawl 24 to 24°.

The illustration in FIG. 12 shows, accordingly, the idle-stroke pawl 24 in its earliest possible engagement position. The idle-stroke pawl 24 is prevented, by the terminal edge 50 of the shallow curve 48, from engaging into the 36° notch S36 of the control disc 4 and can drop only as illustrated into the 24° notch S24. Consequently, during the switching operation included in the cycle, the control disc 4 is moved only through a reduced switching angle of 24°. During the next following switching stroke, the idle-stroke pawl 24 could engage again, being set back 24°, but encounters no notch at this point. the first possibility of dropping is afforded at the 36° notch S36 of the control disc 4, which now stands 12° before the end of the switching angle $\alpha$. After the first idle stroke of the control disc through 24°, a second idle stroke through 12° consequently takes place. After this second idle stroke has been completed, the next 72° notch S72*a* of the control disc is aligned with a notch Z36 of the units wheel 3*a*. By means of the advancing pawl 23*b*, a rotation of the control disc 4 together with the units wheel 3*a* through a full 36° is then effected again.

A complete stroke of 36° of the control disc 4 together with the units wheel is therefore followed, in the switching mode M3, by two idle strokes through 24° and 12°, which are effected as a result of a reduction of the switching angle to 24° by means of the slotted link 5 and as a result of the incomplete 12° toothing on the drive side of the control disc 4.

FIG. 13 illustrates correspondingly the idle-stroke switching for the switching mode M4. The slotted link 5, offset a further 12°, is engaged into the associated notch K4. The switching angle of the idle-stroke pawl 24 is thereby reduced to 12°. Since the toothing, on the drive side, of the control disc 4 has, following the 72° notch S72; S72*a*, three notches S12, S24 and S36 at intervals of 12°, three idle strokes through 12° are executed, before a renewed switching movement through 36° of the units wheel 3*a* together with the control disc 4 is carried out.

The reduction of the switching angle of the idle-stroke pawl 24 by means of the slotted link 5 in the switching modes M2, M3 and M4 is extended in the switching mode M0 (see FIG. 14). Here, the slotted link is offset a further 12° in the advancing direction. The shallow curve 48 of the slotted link 5 no longer coincides, as a result, with the working angle $\alpha$ of the ratchet shaft 22. The idle-stroke pawl 24 runs, lifted out, on the inner ring 11*c* of the slotted link 5 and drops, only as illustrated, at the end of the switching angle $\alpha$ into one of the 72° notches S72, S72*a* of the control disc 4. During this time, there is no movement of wheels.

As already mentioned, in the switching mode M0, M2, M3 and M4, the shallow curve 48 of the slotted link 5 limits the depth of insertion of the idle-stroke pawl 24. The hook 39 shaped on the idle-stroke pawl 24 cannot, as a result, drop into the recessed incisions 37 of the control disc 4. This engagement is released in the switching mode M1 (see FIG. 15). For this purpose, as a result of locking of the slotted link 5 in the notch K1, the recessed curve 49 is placed above the arc of the working angle $\alpha$. In this way, the idle-stroke pawl 24 can pivot epicyclically through a larger angle and can become hooked in the incisions 37. It remains in this engagement position until it is released, in the case of a change of the switching mode, as a result of rotation of the slotted link 5. The control disc 4 is coupled by the idle-stroke pawl 24 to the ratchet shaft 22 in both directions of movement. During each stroke of the ratchet shaft 22, the idle-stroke pawl 24 first moves the control disc 4 in a backward direction and then guides it forwards again into the starting position .

Since the recessed incisions 37 are designed as a continuation of the 72° notches S72; S72*a*, the advancing pawl 23*b* also drops, at the same time as the locking idle-stroke pawl 24, into the 72° notches S72; S72*a*. During this time, there is no hooking on the driven side of the control disc 4. Rather, the advancing pawl 23*b* is lifted out on the inner ring 10*a* of the units wheel 3*a* and is made to engage with the respective next notch Z36 of the gear rim 12*a* on the drive side. In this way, during each stroke of the ratchet shaft 22, the units wheel 3*a* of the counting mechanism 1 is moved on one place.

The control disc 4 is the only wheel of the counting mechanism 1 to execute switching movements in both forward and backward directions. Here, the backward movement via the leaf spring 17 provided with two knobs 20*a*; 20*b* is possible without difficulty. It is advantageous for this backward movement if the leaf spring 17 has a greater length and a lesser rigidity than the other springs 16; 16*a* of the spring comb 14. Moreover, it should be noted that the locking of the control disc 4 requires less precision than that of the number wheels 2; 3.

It is obvious from the functional description that the switching mode of the counting mechanism 1 can be changed after any stroke of a counting series, since the counting mechanism 1 is realigned automatically. For example, after the second stroke in the mode M4, a changeover to the mode M3 can be made directly. Incorrect movements of the control disc 4 are then to be expected, at most, only until the advancing pawl 23*b* is ready for engagement for the first time. After the switching of the units wheel 3*a* together with the control disc 4, which then takes place, the newly selected mode is provided.

The realignment of the counting mechanism 1 is achieved due to the fact that, on the drive side of the control disc 4, only the notches absolutely essential for the particular switching mode are recessed. Thus, the invention is not restricted to the division described, with a five-digit symmetry and with an incomplete 12° toothing. Rather, over the switching angle of 36° predetermined by the decimal advancing, a greater number of notches (not shown) can also be accommodated for the idle-stroke pawl 24, in order to effect an even greater stepping-down of the counting mechanism 1, in conjunction with a suitably adapted slotted link.

I claim:

1. In a mechanism for idling and advancing wheels of a stepping device having a locking shaft for supporting said wheels for rotation relative to said locking shaft and to each other to facilitate stepping, said wheels arranged in series upon said locking shaft such that a driven side surface of each of said wheels abuts and slideably engages a drive side surface of an adjacent wheel of said series, said device further having a ratchet shaft located interiorly of and rotating to and fro through a working angle relative to said locking shaft upon operation of the mechanism, said ratchet shaft supporting a series of advancing pawls for movement through said working angle upon operation of said device and for rotation relative to said ratchet shaft and to each other, each of said advancing pawls engageable with inner rims of a corresponding pair of said wheels for stepped advancing of at least one of said pair according to a switching mode, said device further comprising a control disc for controlling idling and advancing of at least one of said wheels according to said switching mode, the improvement comprising:

an adjustable link means, integral with said mechanism, for selective changing of said switching mode between different stepping modes of operation comprising different sequences of idling and advancing of said wheels;

said control disc being an end wheel of said series; and an idle stroke pawl engageable with said control disc according to said switching mode;

wherein, during operation of said mechanism in said stepping modes, said control disc is advanced by said idle stroke pawl during idling of remaining wheels of said series, and is advanced by an advancing pawl during advancing of at least one of said remaining wheels.

2. An improvement as in claim 1, wherein an idling mode of said switching modes is selectable by said link means such that said control disc and said remaining wheels are idle and no stepping occurs during operation of said mechanism in said idling mode.

3. An improvement as in claim 1, and further comprising:

said idle stroke pawl being mounted upon said ratchet shaft relative to said locking shaft in the same manner as said advancing pawls so as to be engageable with the inner rim of said control disc.

4. An improvement as in claim 3, and further comprising:

said link means being another wheel adjustable rotatably upon said locking shaft to a set switching mode position relative to said working angle and engageable by said idle stroke pawl such that rotation and idling of said control disc by said idle stroke pawl is selective according to said set position.

5. An improvement as in claim 4, and further comprising:

said link means, control disc, and remaining wheels each having an inner rim and being mounted by said rims in series upon said locking shaft with adjacent side surfaces of said rims slideably abutting such that said pawls are concealed for actuation within said rims and closer spacing of said wheels to each other is provided.

6. An improvement as in claim 5, wherein:

said control disc further comprises recurring sets of notches in and spaced about the inner rim on a drive side of said disc and notches in and spaced about the inner rim on a driven side of said disc, said driven side notches each axially communicating with a notch of a corresponding drive side set of notches;

said link means comprises a deep slot and a shallow slot in and partially extending about the inner rim on a driven side of said link means, said driven side inner rim with said slots defining radially outer limits of pivoting of said idle stroke pawl and driving engagement of said idle stroke pawl with said control disc drive side notches during operation of said mechanism according to said set position;

at least one of said remaining wheels comprising notches in and spaced about the inner rim on a drive side thereof, such that a corresponding advancing pawl is simultaneously engageable with a driven side notch of said control disc and a drive side notch of said one of said remaining wheels in axial alignment thereof; and an arrangement of said notches and slots relative to each other such that, during operation of said mechanism in one of said stepping modes, said one of said remaining wheels is coupled to and advanced with said control disc, via said corresponding advancing pawl, by one step for each operation of said mechanism.

7. An improvement as in claim 6, wherein said drive side sets of notches of said control disc each comprise:

at least one long notch arranged such that said idle stroke pawl is drivingly engageable with said control disc over at least a portion of said working angle so that said control disc is at least incrementally advanced through said portion and said idle stroke pawl is nondrivingly slideable in and along at least a portion of said long notch to prevent driving engagement of said control disc by said idle stroke pawl, wherein, during operation of said mechanism in at least another said stepping modes, said control disc is advanced through at least a portion of said working angle by driving engagement with said idle stroke pawl and said corresponding advancing pawl is not drivingly engageable with said control disc to define an idling stroke of said mechanism, and said idle stroke pawl non-drivingly slides in said long notch while said corresponding advancing pawl couples and drivingly engages said control disc and said one of said remaining wheels through said working angle to define an advancing stroke of said mechanism.

8. An improvement as in claim 7, and further comprising:

spacing of said drive side notches of said control disc such that different sequences of said idle strokes and said advancing strokes facilitate still other stepping modes according to different set positions of said link means.

9. An improvement as in claim 6 and further comprising:

a deep notch of each of said sets of drive side control disk notches;

a hook portion of said idle stroke pawl, said hook portion mateable with a deep notch according to a set position of said link means such that said idle stroke pawl non-drivingly slides in said link means deep slot to facilitate mating of said hook and said deep notch;

wherein said control disc rotates fully to and fro over said working angle with said ratchet shaft during mating of said hook and said deep notch and operation of said mechanism.

10. An improvement as in claim 4, and further comprising:

holding notches in and spaced about a drive side inner rim of said link means and selectively engageable with holding means of said locking shaft for holding said link means in a set position during operation of said mechanism in a selected switching mode.

11. An improvement as in claim 6, wherein:

said control disc driven side notches comprise five notches equally spaced in 72° intervals about said inner rim, each of said driven side notches axially communicating with a notch of a corresponding set of drive side notches of said disc;

each set of said control disc drive side notches comprises a first notch portion axially communicating with a control disc driven side notch, a second notch spaced 12° from said first notch portion, a third notch spaced 24° from said first notch portion, and a long notch having a front driving surface spaced 36° from said first notch portion and a rear portion comprising the first notch portion of an adjacent set;

said driven side deep and shallow slots communicating with each other and each slot extending generally 36° about the inner rim of said link means; and said drive side notches of said one of said remaining wheels comprises ten notches equally spaced in 36° intervals about said inner rim thereof.

12. An improvement as in claim 6, and further comprising:

at least another of said remaining wheels comprising drive side notches in the manner of said one of said remaining wheels;

said one of said remaining wheels and said other remaining wheel each further comprising at least one notch in a driven side inner rim thereof and communicating axially with a corresponding drive side notch such that an advancing pawl is drivingly engageable in said one notch of said one of said remaining wheels and in a drive side notch of said other remaining wheel to advance said other remaining wheel through said working angle upon operation of the mechanism, according to axial alignment of and a ratio between said driven side notch of said one of said remaining wheels and said drive side notches of said other remaining wheel.

13. An improvement as in claim 7, and further comprising:

holding means of said lock shaft for engaging at least one notch of said control disc sets and for preventing a return of said control dic backward in said working angle upon advancing of said control disc, according to said switching mode.

14. An improvement as in claim 1, said remaining wheels further comprising:

counting wheels.

15. An improvement as in claim 1, said remaining wheels further comprising:

printing wheels.

16. An improvement as in claim 1, said remaining wheels further comprising:

wheels of a manually actuated labeling machine.

* * * * *

UNITED STATES PATENT AND TRADEMARK OFFICE

CERTIFICATE OF CORRECTION

PATENT NO. : 4,419,571

DATED : December 6, 1983

INVENTOR(S) : Ulf Koch

It is certified that error appears in the above-identified patent and that said Letters Patent are hereby corrected as shown below:

On the title page at [73] where the assignee is indicated, please change "Esselte Pendeflex Corporation," to -- Esselte Pendaflex Corporation,--.

Signed and Sealed this

Tenth Day of April 1984

[SEAL]

Attest:

GERALD J. MOSSINGHOFF

Attesting Officer

Commissioner of Patents and Trademarks